US010053197B1

(12) United States Patent
Wencloff

(10) Patent No.: US 10,053,197 B1
(45) Date of Patent: Aug. 21, 2018

(54) REVERSE ROWING DEVICE

(71) Applicant: Chris Wencloff, Bullhead City, AZ (US)

(72) Inventor: Chris Wencloff, Bullhead City, AZ (US)

( * ) Notice: Subject to any disclaimer, the term of this patent is extended or adjusted under 35 U.S.C. 154(b) by 0 days.

(21) Appl. No.: 15/397,641

(22) Filed: Jan. 3, 2017

(51) Int. Cl.
*B63H 16/04* (2006.01)
*B63H 16/10* (2006.01)

(52) U.S. Cl.
CPC ..... *B63H 16/102* (2013.01); *B63H 16/04* (2013.01)

(58) Field of Classification Search
CPC ..... B63H 16/102
See application file for complete search history.

(56) References Cited

FOREIGN PATENT DOCUMENTS

DE 3813968 A1 * 12/1988 ..... B63H 16/102
FR 2603248 A1 * 3/1988 ..... B63H 16/102

* cited by examiner

*Primary Examiner* — Edwin Swinehart
(74) *Attorney, Agent, or Firm* — Morgan Law Offices, PLC

(57) ABSTRACT

A pair of rowing devices is installed on respective port (left) and starboard (right) sides of a watercraft such as a rowboat, kayak or canoe. Unlike in conventional rowing the operator sits forward facing the bow (front). By pulling the inboard portion of the oars towards the stern (back) while the blade is in the water, the watercraft is propelled forward. The system described herein reverses the direction of the blades motion through the water using a gearbox. The gearbox also allows for feathering of the paddles, that is, changing the angle of the paddle in relation to the water. This is done by turning the handle throughout the movement of the oars as done with traditional oars.

4 Claims, 6 Drawing Sheets

Side

End

Top

REVERSE ROWING DEVICE

BACKGROUND OF THE INVENTION

1. Field of the Invention

The present invention relates to a propulsion system for watercraft, and more specifically to a reverse rowing device for small watercraft.

2. Description of the Related Art

Rowing is the act of propelling a watercraft using the motion of oars in the water. In conventional rearward-facing systems, a seated rower pulls on the oars, which levers the watercraft through the water. The pivot point of the oars (attached solidly to the watercraft) is the fulcrum. The motive force is applied through the rower's feet. Sculling involves a seated rower who pulls on two oars or sculls, attached to the watercraft thereby moving the watercraft in the direction opposite that which the rower faces. Push rowing, also called back-watering if used in a watercraft not designed for forward motion, uses regular oars with a pushing motion to achieve forward-facing travel, sometimes seated and sometimes standing. This is a convenient method of maneuvering in a narrow waterway or through a busy harbor.

Watercrafts have been rowed backward because the human body has its muscle power concentrated in the back muscles, shoulders, and biceps. This makes pulling a more efficient motion than pushing, meaning the rower becomes less fatigued, more energy is transferred to the oars, and the vessel travels farther with each stroke.

SUMMARY OF THE INVENTION

A pair of rowing devices is installed on respective port (left) and starboard (right) sides of a watercraft such as a rowboat, kayak or canoe. Unlike in conventional rowing the operator sits forward facing the bow (front). By pulling the inboard portion of the oars towards the stern (back) while the blade is in the water, the watercraft is propelled forward. The system described herein reverses the direction of the blades motion through the water using a gearbox. The gearbox also allows for feathering of the paddles, that is, changing the angle of the paddle in relation to the water. This is done by turning the handle throughout the movement of the oars as done with traditional oars.

DETAILED DESCRIPTION OF THE INVENTION

Figure 1:
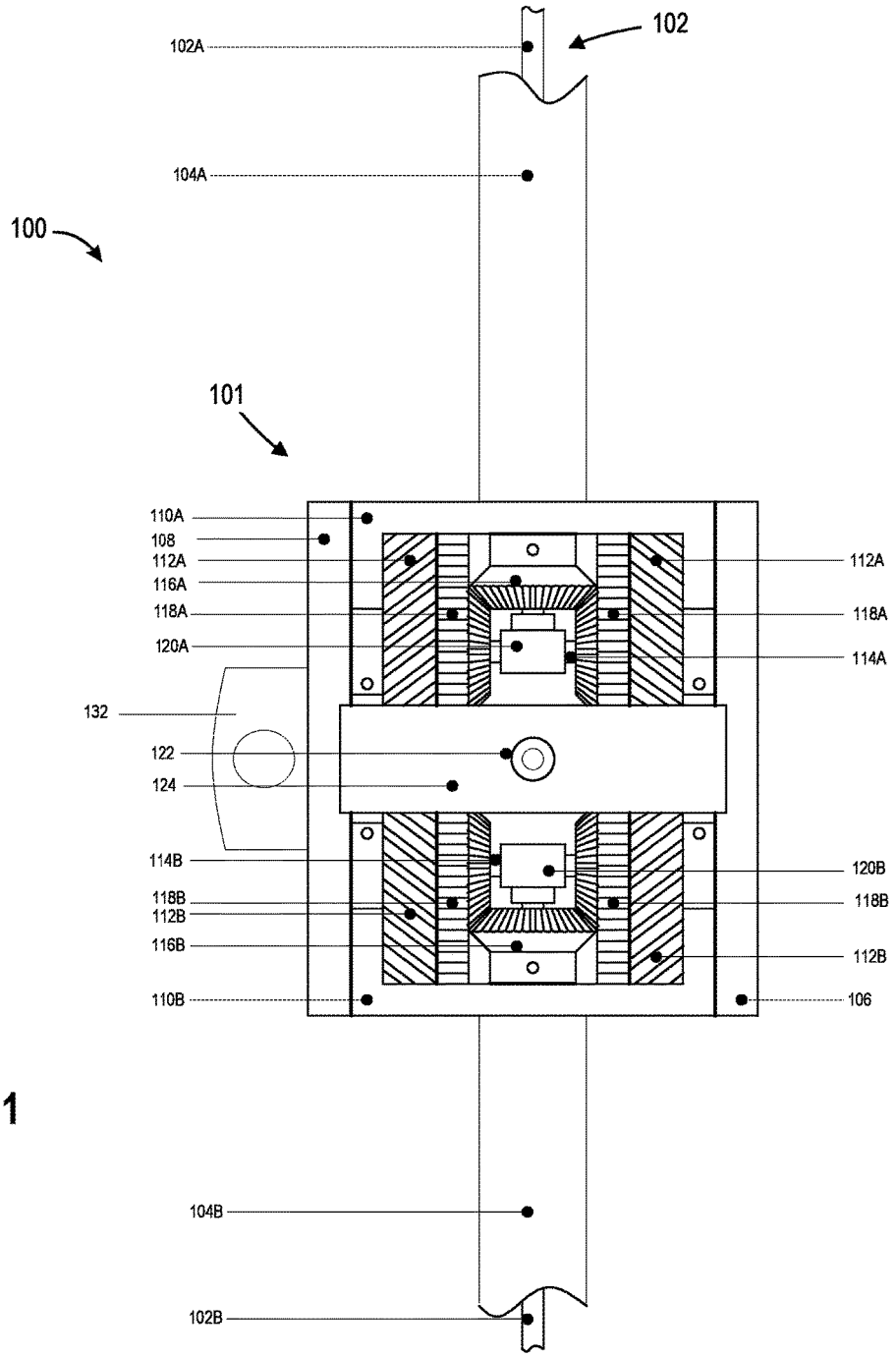
FIG. 1 illustrates a side view of a reverse rowing device, in accordance with one embodiment of the present invention.

Referring to FIG. 1, a side view of a reverse rowing device 100, in accordance with an embodiment of the present invention, is illustrated. The reverse rowing device 100 comprises a gearbox 101 and a rotational shaft 102. The rotational shaft 102 is divided into a first rotational shaft portion 102A and a second rotational shaft portion 102B. The first rotational shaft portion 102 and the second rotational shaft portion 102B are contained within a first shaft tube 104A and a second shaft tube 104B, respectively. In one embodiment, the first rotational shaft portion 102A and the second rotational shaft portion 102A are metal rods and the shaft tubes, 104A, 104B are made from wood. However, in other embodiments, other suitable materials may be used. For example, the shaft tubes, 104A, 104B could be constructed of fiberglass, plastic, rubber or a composite. For illustrative purposes, the gearbox 101 is shown with a side panel removed so as to expose the gear assembly disposed therein.

Figure 2:
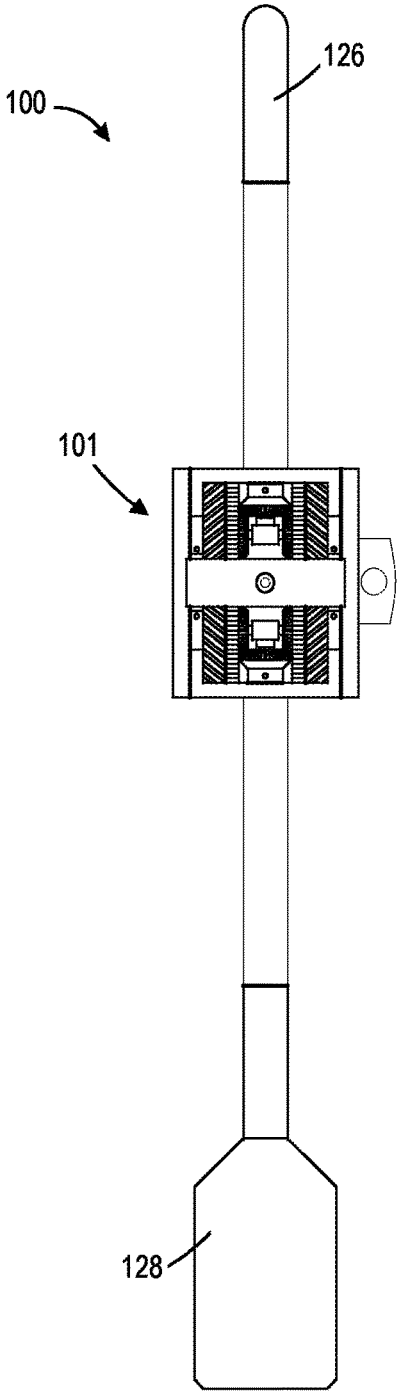
FIGS. 2 and 3 illustrate views of the reverse rowing device with the handle and the blade attached, in accordance with one embodiment of the present invention.

Referring to FIG. 2, a top view of the reverse rowing device 100 with a handle 126 and a blade 128 attached, in accordance with an embodiment of the present invention, is illustrated. The handle 126 is attached internally to the rotational shaft 102B and is in communication with the shaft tube 104B to provide structural rigidity and allow the handle 126 to sit against the surface of the shaft tube 104B. In one embodiment, the handle 126 is made from wood. In other embodiments, the handle 126 can be made from, but not limited to, a metal, plastic, or compound material. The length, diameter, and contour of the handle 126 can be machined to provide a variety of looks and styles as well as provide a more ergonomically efficient design. Although the handle 128 can be a separate device attached to the rotational shaft 102B, it could also simply be an end portion of the shaft tube 104B.

In one embodiment, rotation of the handle clockwise results in the blade 128 being rotated counter-clock-wise and vise-versa. This can be useful when the operator wishes to feather the blade 128. In another embodiment, the rotation of the handle 126 in a clockwise direction results in the blade 128 rotating in a clockwise manner. The rotation of the handle 126 to the blade can be 128 is 1-to-1 or, in other embodiments, of varying ratios. The blade 128 is attached internally to the rotational shaft 102A and is in communication with the shaft tube 104A to provide structural rigidity and allow the handle 126 to sit against the surface of the shaft tube 104A. In one embodiment, the blade 128 is made from wood. In additional embodiments, the blade 128 can be made from, but not limited to, a metal, plastic, or compound material. The length, diameter, and contour of the blade 128 can modified to provide a variety of designed dependent upon the intended user of the reverse rowing device 100 and the size and weight of the watercraft the system 100 is attached to.

Figure 3:
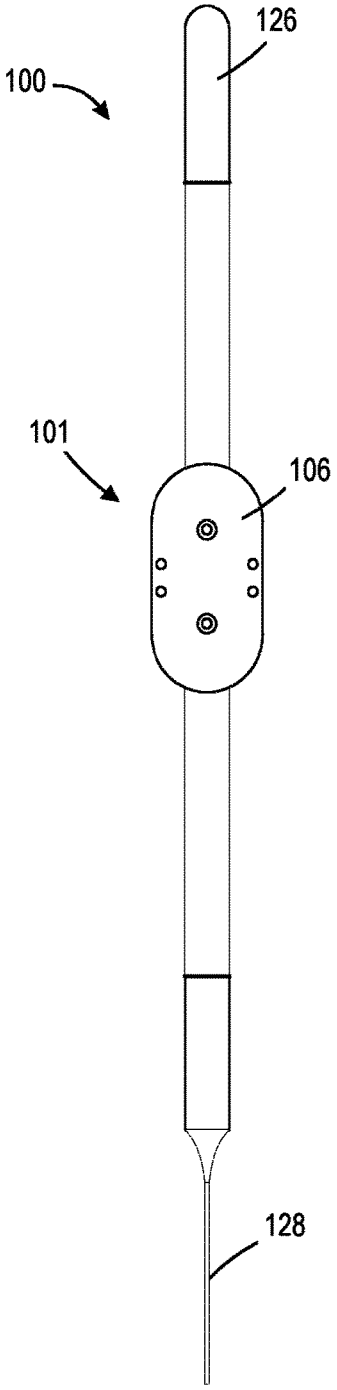

Referring to FIG. 3, a side view of the reverse rowing device 100 with the handle 126 and the blade 128 attached, in accordance with one embodiment of the present invention, is illustrated. The upper frame bracket 106 is shown. The upper frame plate 106 is designed to contain and protect the internal components of the reverse rowing device 100 from damage, as well as provide structural rigidity to the reverse rowing device 100. The upper frame bracket 106 can be made from, but not limited to metals, plastics, or composites; provided the upper frame bracket 106 has the structural rigidity to properly protect the internal components. In the illustrated embodiment, the upper frame bracket 106 has openings, two of which are sized to fit the vertical axle 114, and the other openings are sized to fit the proper mounting equipment to secure the upper frame plate 106 to the rest of the frame structure.

In operation, two reverse rowing devices 100 would be installed to a watercraft, each one on an opposite side of the watercraft. For each device 100, the first shaft tube 104A is used as the inboard of a traditional oar would be used in operating a watercraft. However, when the shaft tube 104A is pulled toward the operator, the gearbox 101 acts to transfer this motion so as to cause the second shaft tube 104B to move backwardly. Thus, the blades push water to propel the watercraft forward. Accordingly, the operator can sit with face looking toward the front of the watercraft as he or she rows, and the watercraft will move in a forward direction.

Referring again to FIG. 1, a distal end of the first rotational shaft portion 102A, opposite to the end with the handle 126, is attached to a first rotational bevel gear 116A within the gear box 101. Similarly, a distal end of the second rotational shaft portion 102B, opposite to the end with the blade 128, is attached to a second rotational bevel gear 116B within the gear box 101. The gear box 101 additionally includes a lower frame plate 108, drive gear brackets 110A, 110B, drive gears 112A, 112B, vertical axles 114A, 114B, spur gears 118A, 118B, bearings 120A, 120B, a horizontal frame brace 122, a frame side brace 124, and a mount 132.

In the illustrated embodiment, the set of internal components 102A, 110A, 114A, 116A, 118A, and 120A are identical to the set of components 102B, 110B, 114B, 116B, 118B, and 120B, respectively. For discussion purposes hereinafter, focus will be on the first set of components 102A, 110A, 114A, 116A, 118A, and 120A, though it is to be understood that the structure and arrangement will be the same for the other set of components 102B, 110B, 114B, 116B, 118B, and 120B.

As illustrated, the rotational bevel gear 116A is attached to the rotational shaft 102A a predetermined distance from the end of the rotational shaft 102A leaving a portion of the rotational shaft 102A extending through the rotational bevel gear 116A. The rotational bevel gear 116A has a predetermined number of grooves at a predetermined angle. In further embodiments, the number of grooves and the angle of the grooves can be altered.

The bearing 120A is in communication with the portion of the rotational shaft 102A that extends beyond the rotational bevel gear 116A. In the shown embodiment, the portion of the rotational shaft 102A is inserted into the bearing 120A a predetermined distance. The bearing absorbs the torque effect from the gears, keeping the gears in alignment.

The vertical axle 114A is inserted through the bearing 120A. The vertical axle 114A is a predetermined length to allow the vertical axle 114A to extend through the bearing 120A to allow the spur gears 118A and the drive gears 112A to connect with the vertical axle 114A. The vertical axle 114A is sized to fit securely through the bearing 120A, spur gears 118A and the driver gears 112A. The vertical axle 114A is designed to rotate all gears attached to the vertical axle 114A to rotate independently of one another.

The spur gears 118A are designed to accept the portion of the vertical axle 114A that extends beyond the bearing 120A. The spur gear 118A is comprised of at least two different gears, interconnected to rotate in unison. In the shown embodiment, the two gears are of different diameters and different groove patterns. In additional embodiments, the two gears can be of substantially similar sizes and/or substantially similar groove patterns. The first gear is sized to connect with the rotational bevel gear 116A. The second gear is sized to connect with a substantially similar gear.

The drive gears 112A are designed to connect with the vertical axle 114A and rotate independently of the spur gears 118A. The drive gears 112A have a predetermined diameter and groove structure to rotate with the reciprocal drive gear 112A with minimal slippage.

Figure 4:
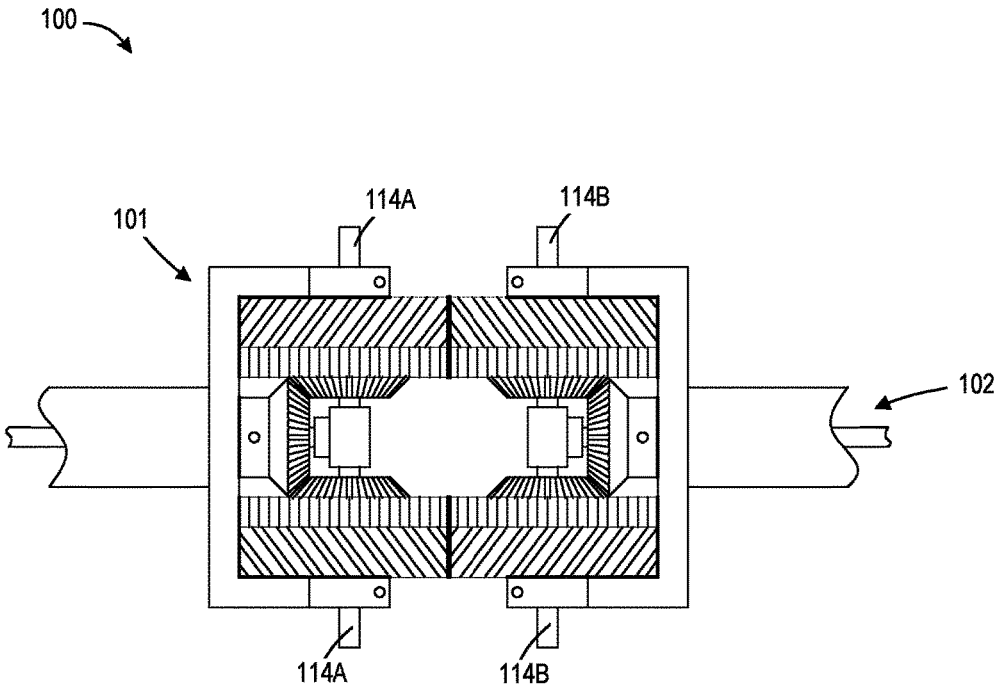
FIG. 4 illustrates a side view of the reverse rowing device with the frame plates removed, in accordance with one embodiment of the present invention.

Referring to FIG. 4 a section view of the reverse rowing device 100 with parts of the frame removed, in accordance with one embodiment of the present invention, is illustrated. Notably, the vertical axles 114A, 114B are shown exposed.

Figure 5:
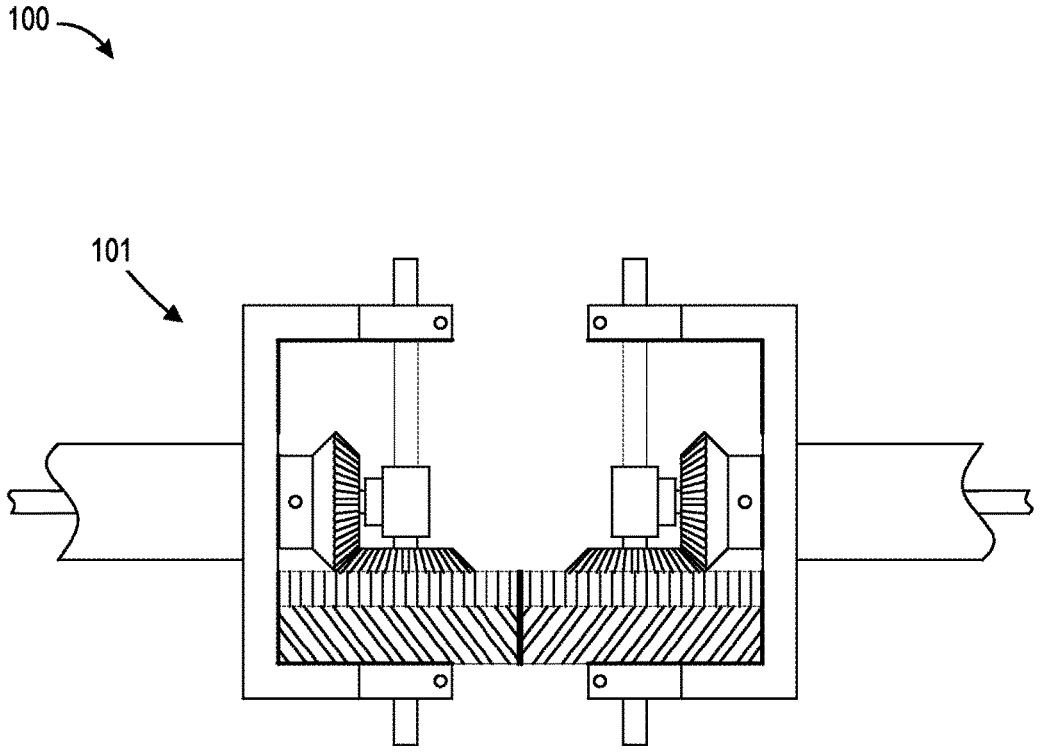
FIG. 5 illustrates a section view the reverse rowing device with parts of the frame removed, in accordance with one embodiment of the present invention.

Referring to FIG. 5, a side view of the reverse rowing device 100, in accordance with one embodiment of the present invention, is illustrated. In the shown embodiment, the bottom half of the reverse rowing device 110 is shown. In this embodiment, the top and bottom halves are substantially identical to one another. In additional embodiments, the two halves can be substantially unique provided all elements of each half interlock correctly for the reverse rowing device 100 to operate.

Figure 6:
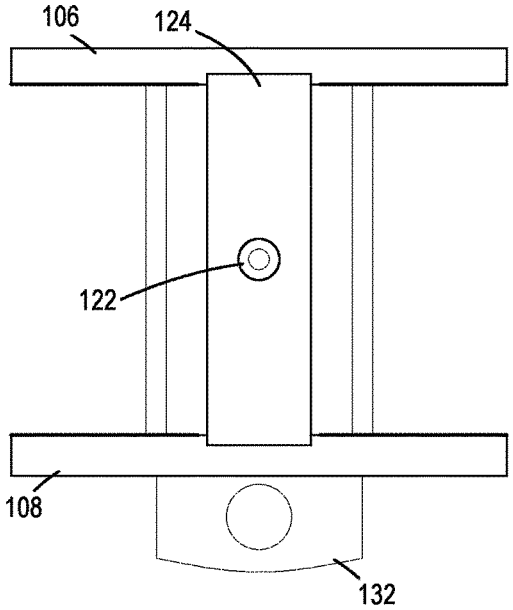
FIG. 6 illustrates a side view of the reverse rowing device frame, in accordance with one embodiment of the present invention.
Figure 7:
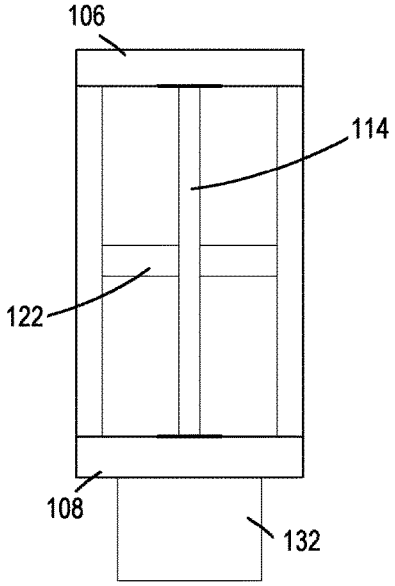
FIG. 7 illustrates an end view of the reverse rowing device frame, in accordance with one embodiment of the present invention.
Figure 8:
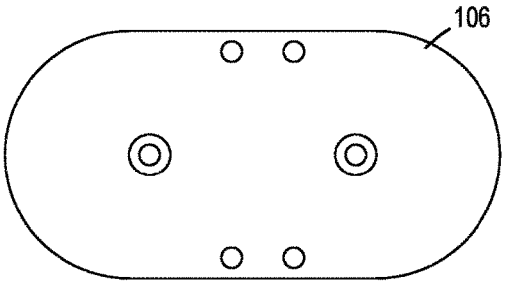
FIG. 8 illustrates a top view of the reverse rowing device frame, in accordance with one embodiment of the present invention.

Referring to FIGS. 6-8 illustrate the reverse rowing device 100 frame members shown in different views, according to an embodiment.

The lower frame plate 108 is designed to contain and protect the internal components of the reverse rowing device 100 from damage, as well as provide structural rigidity to the reverse rowing device 100. The lower frame bracket 108 can be made from, but not limited to metals, plastics, or composites; provided the upper lower bracket 108 has the structural rigidity to properly protect the internal components.

The mount 132 is designed to attach the reverse rowing device 100 to the watercraft. In the shown embodiment, the mount 132 is attached to the lower frame plate 108. In additional embodiments, the mount 132 and the lower frame plate 108 are a unitary element of the frame structure.

The drive gear bracket 110 is designed to stabilize and protect the gears of the reverse rowing device 100. The vertical axle 114A is inserted into the drive gear bracket 110 to stabilize the vertical axle 114A and allow the gears to interconnect with one another. The drive gear bracket 110 can be made from, but not limited to metals, plastics, or composites; provided the drive gear frame bracket 110 has the structural rigidity to properly protect the internal components.

The horizontal frame brace 122 is designed to contain and protects the internal components of the reverse rowing device 100 from damage, as well as provide structural rigidity to the reverse rowing device 100. The horizontal frame brace 122 can be made from, but not limited to metals, plastics, or composites; provided the horizontal frame brace 122 has the structural rigidity to properly protect the internal components.

The frame side brace 124 is an opening sized to fit the mounting equipment, for mounting the reverse rowing device 100 onto a watercraft. The frame brace 124 can be made from, but not limited to metals, plastics, or composites; provided the frame side brace 124 has the structural rigidity to properly protect the internal components and remain mounted to the mounting equipment.

Figure 9:
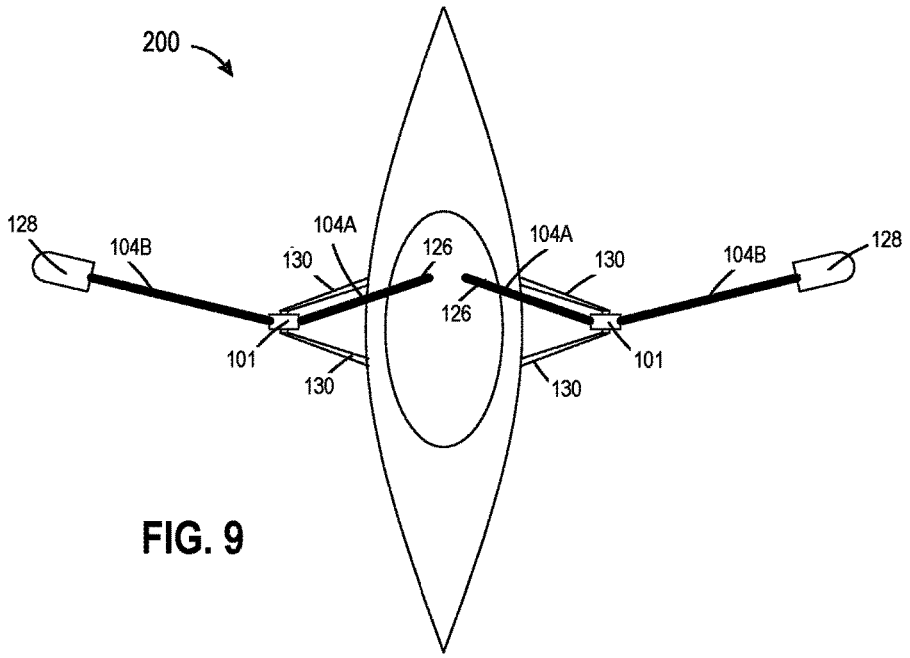
FIG. 9 illustrates the reverse rowing device installed on a watercraft in a first position, in accordance with one embodiment of the present invention.

FIG. 9 illustrates the reverse rowing device 100 installed on the watercraft 200 in a second position, in accordance with one embodiment of the present invention. It is shown that the handle 126 and the blade 128 are pointed forward. In this position, the operator is ready to perform the next stroke in the rowing cycle.

Figure 10:
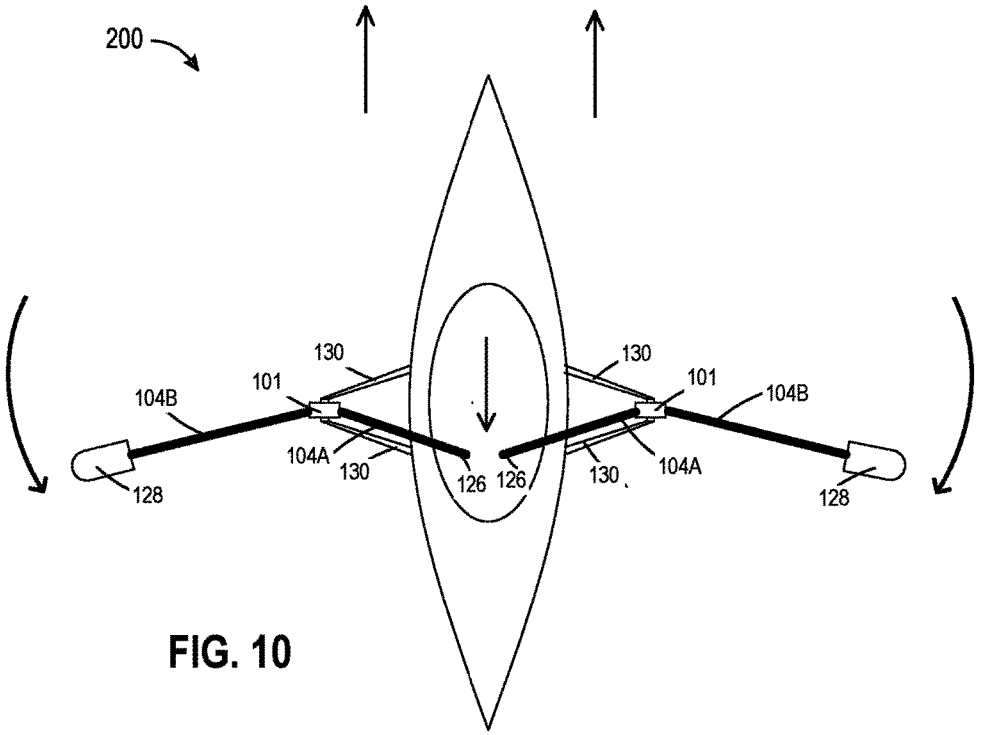
FIG. 10 illustrates the reverse rowing device installed on the watercraft in a second position, in accordance with one embodiment of the present invention.

FIG. 10 illustrates the reverse rowing device 100 installed on a watercraft 200 in a first position, in accordance with an embodiment of the present invention. A watercraft 200 is shown with the reverse rowing device 100 mounted to support members 130, with the handles 126 and the blades 128 attached to the respective reverse rowing devices 100. The watercraft 200 can be, but not limited to canoes, rowboats, kayaks and the like. The support members 130 are sized to attach to the watercraft 200 and the reverse rowing device 100 at a predetermined distance from the center axis of the watercraft 200. This distance is determined by the length of the handle shaft tubes, so that the reverse rowing devices 100 are ergonomically positioned for the user. It is shown that the watercraft 200 is propelled forward with both the handle 126 and the blade 128 pointed rearward. This allows the operator of the watercraft 200 to be positioned facing forward with the watercraft 200 moving forward.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A reverse rowing device comprising:

a structural frame comprising:

at least two brackets, wherein the at least two brackets have an opening;

an upper frame member, wherein the upper frame member is secured to the at least two brackets and the upper frame member has a plurality of openings;

a lower frame member, wherein the lower bracket is secured to the at least two brackets and the upper frame member; and a mount, wherein the mount is attached to the lower bracket; and a gear assembly comprising:

a rotational shaft, having a first end and a second end;

a bevel gear disposed on the rotational shaft a predetermined distance from the first end of the rotational shaft;

a bearing having a first opening and a second opening, wherein the first end of the rotational shaft is inserted into the first opening of the bearing;

an axle, wherein the axle is inserted through the second opening of the bearing and a substantially equal length of the axle extends out of both sides of the bearing;

spur gears with an opening, wherein the axle is inserted into the opening of the spur gears and the spur gear are in contact with the bevel gear; and a driver gear with an opening, wherein the axle is inserted into the opening of the driver gear; and a handle attached to the second end of the rotational shaft wherein the rotation of the handle results in rotation of the rotational shaft.

2. The revere rowing device of claim 1, wherein the lower frame member and the mount are a unitary component.

3. The reverse rowing device of claim 1, further comprising a shaft tube, wherein the shaft tube is inserted over the rotational shaft.

4. A reverse rowing device comprising:

a first rotational shaft, having a first end and a second end;

a second rotational shaft, having a first end and a second end;

a gear assembly comprising:

a first bevel gear disposed on the first rotational shaft a predetermined distance from the first end of the first rotational shaft;

a first bearing having a first opening and a second opening, wherein the first end of the first rotational shaft is inserted into the first opening of the first bearing;

a first axle, wherein the first axle is inserted through the second opening of the first bearing and a substantially equal length of the first axle extends out of both sides of the first bearing;

first spur gears with an opening, wherein the first axle is inserted into the opening of the spur gears and the first spur gears are in contact with the first bevel gear; and a first driver gear with an opening, wherein the first axle is inserted into the opening of the first driver gear; and a handle attached to the second end of the first rotational shaft;

a second bevel gear disposed on the second rotational shaft a predetermined distance from the first end of the second rotational shaft;

a second bearing having a first opening and a second opening, wherein the first end of the second rotational shaft is inserted into the first opening of the second bearing;

a second axle, wherein the second axle is inserted through the second opening of the second bearing and a substantially equal length of the second axle extends out of both sides of the second bearing;

second spur gears with an opening, wherein the second axle is inserted into the opening of the second spur gears and the second spur gears are in contact with the second bevel gear; and a second driver gear with an opening, wherein the second axle is inserted into the opening of the second driver gear; and a blade attached to the second end of the second rotational shaft.

* * * * *